US006026587A

United States Patent [19]

Cunkelman et al.

[11] Patent Number: 6,026,587

[45] Date of Patent: Feb. 22, 2000

[54] INTERCOOLER BLOWDOWN VALVE

[75] Inventors: Brian L. Cunkelman, Blairsville; Daniel G. Wagner, Pittsburgh; Walter E. Goettel, Monongahela, all of Pa.

[73] Assignee: Westinghouse Air Brake Company, Wilmerding, Pa.

[21] Appl. No.: 09/113,983

[22] Filed: Jul. 10, 1998

[51] Int. Cl.[7] ..... F04B 19/24; F04B 47/12

[52] U.S. Cl. ..... 34/53; 34/243

[58] Field of Search ..... 417/243, 251, 417/307, 326, 440, 53; 137/112, 627.5, 516.23; 95/17, 19; 96/130, 133; 34/80, 81, 82

[56] References Cited

U.S. PATENT DOCUMENTS 4,247,311 1/1981 Seibert et al. ..... 55/162
5,106,270 4/1992 Goettel et al. ..... 417/243
5,362,207 11/1994 Martin et al. ..... 417/243
5,785,081 7/1998 Krawcyzk et al. ..... 137/16.23
5,885,060 3/1999 Cunkelman et al. ..... 417/243

*Primary Examiner*—Stephen Gravini
*Attorney, Agent, or Firm*—James Ray & Associates

[57] ABSTRACT

Apparatus for rapidly exhausting air pressure from an intercooler pneumatically connected to receive compressed air from an air compressor. The apparatus includes a blowdown valve pneumatically connected to receive air pressure contained in the intercooler. The valve has a large exhaust port and a valve member seatable against the port to open and close the same. An inlet port is provided for admitting a compressor unload signal to the valve, with the unload signal being effective to move the valve member away from the large exhaust port to allow rapid exhaustion of intercooler air pressure to atmosphere through the exhaust port.

8 Claims, 2 Drawing Sheets

INTERCOOLER BLOWDOWN VALVE

FIELD OF THE INVENTION

The present invention relates, in general, to a valve structure for rapidly exhausting air and, more particularly, this invention relates to a valve structure for the rapid release of air pressure in an intercooler or in intercoolers connected to receive compressed air from an air compressor. The intercooler(s) that are referred to here and hereinafter represent the volume(s) of the cooling core (or cores) of the intercooler(s) and all associated piping/connectors which, also, have their own volumes which must be exhausted in accordance with the principles of the invention.

BACKGROUND OF THE INVENTION

U.S. Pat. No. 5,106,270 to Goettel et al discloses an air compressor comprised of two low pressure cylinders each of which discharges low pressure air into respective intercoolers to cool the compressed air before it enters a common manifold connection and inlet flange of a high pressure cylinder. A single intercooler core design is also available that collectively receives the air discharged from such low pressure cylinder heads and cools the air before entering the high pressure head's inlet flange for the second stage of compression.

The compressor can be driven by an electric motor, as disclosed in the Goettel et al patent, though in times past, compressors in locomotives were driven directly by the diesel engine of the locomotive. In this manner, while the diesel engine was idling, the compressor continued to run, though at the slower idle speed of the diesel engine.

More recent compressor designs, however, are operated by electric motors in a stop/start fashion. In this mode of operation, the compressors are started when pressurized air is needed and stopped when pressurized air is not needed. Such electric motors operate from a voltage generated by an alternator, disposed in the locomotive, which is driven by the diesel engine of the locomotive. When diesel engine RPM is low, such as in an idle condition, the alternator produces only a limited amount of electrical power. Such a limited amount of power may be insufficient to operate the compressor motor at a speed sufficient for the compressor to deliver the required amount of compressed air to the train. When this occurs, the air compressor needs to operate at a speed greater than that at which the motor is capable of when it is only supplied by the electrical characteristics of the alternator.

For this reason, compressor motors may have a dual pole, dual speed configuration. For example, the motor may consist of the same number of magnetic poles as the supply voltage alternator. For low speed operation, since the poles of the motor and alternator are equal, the compressor turns at essentially the same speed as the alternator (and the mechanical drive of the diesel engine) less any losses, of course.

If the compressor can run faster than engine speed (such as an idle speed), to assure a compressed air output to overcome train line losses there will be only the need to reduce the number of active motor poles. For example, if the number of motor poles is reduced in half the compressor will run at twice the diesel engine/alternator speed. In this manner, the locomotive crew can operate the locomotive at a lower engine speed (to save fuel and reduce engine wear) while, at the same time, produce a sufficient amount of compressed air for the brakes and other pneumatically operated devices.

When additional air pressure is called for, the compressor motor is signaled to operate at the higher speed. When this occurs, the compressor is unloaded (exhausted) of air pressure so that the motor can start (transition) under unloaded conditions. When the compressor is unloaded, the compressor rotates freely and thus places a very light load on the electric motor. If the motor is required to start or transition against a pressure load in the compressor, the rotor of the compressor can appear to the motor to be locked, and can thereby burn out the motor, as the motor draws large amounts of current to overcome the force of compression in the compressor.

The compressor rotor includes a crankshaft that operates the pistons disposed in the cylinders of the compressor. The pistons being the mechanism by which the compressed air is formed in the compressor. It is therefore understandable that with air pressure in the cylinders acting against the pistons and thus against the crankshaft of the compressor, the electric motor connected to drive the compressor has a difficult task in rotating the crankshaft.

The air compressor will normally unload when the increase in the main reservoir pressure reaches about 140 psig. At this point, a compressor governor or compressor control switch admits air to an unloader line connected to unloader inlet valves located on the cylinder heads to move and hold an inlet valve off its seat thereby preventing further compression of air. The cylinders, cylinder heads and intercooler are vented to atmosphere via an exhaust vent in the unloader valve. The intercooler pressure vents to atmosphere through the unloader valves and vents. Such unloader venting takes about 25 seconds.

Historically, this time period was not important because the compressor was operated constantly by the diesel engine of the locomotive and would load and unload as needed (under the control of the governor). The time it takes for a dual pole configuration motor to transition from its relatively slow speed (twelve pole) operation to the doubling high speed (six pole) operation is on the order of two to three seconds. Hence, when the motor changes speed there may still be air pressure in the high pressure head of the compressor, as supplied by the intercooler(s). It is therefore important that intercooler air pressure be discharged quickly so that the compressor motor does not have to start, i.e., change speeds, against a pressure load in the high pressure cylinder of the compressor.

SUMMARY OF THE INVENTION

The present invention solves the above problem by providing the intercooler with an exhaust or blowdown valve having a large exhaust opening. The valve being operated by the same pneumatic signal that unloads the unloader inlet valves on the compressor heads. The blowdown valve is a poppet like valve designed to permit the pneumatic unload signal to open the valve and its large exhaust opening so that the intercooler quickly exhausts its air. In this manner, intercooler air pressure is not present in the compressor head when the change in motor speed takes place.

The blowdown valve has a housing provided with a first port for receiving the pneumatic signal and a second port for receiving the volume of air within the intercooler. The second port is connected directly to the large exhaust opening when a valve member connected to a piston is moved from its seat by the unloader pilot pressure.

When the pneumatic signal is removed from the valve's piston, a spring in the valve forces the valve member against its seat and thereby closes the large exhaust opening. This allows air pressure to build in the cylinders of the compressor for supplying the air pressure needs on a locomotive and railway cars mechanically and pneumatically connected to the locomotive.

OBJECTS OF THE INVENTION

It is, therefore, a primary object of the present invention to provide a simple valve structure with a large exhaust opening for rapidly exhausting intercooler air pressure, including the volumes of associated piping and fittings, when the compressed air of an air compressor reaches the compressor governor's unloader pressure setting. This allows a compressor motor speed change to occur on a completely unloaded compressor.

The above object and various additional objects and advantages of the present invention will become more readily apparent to those persons skilled in the air compressor art form the following more detailed description of the invention, particularly, when such description is taken in conjunction with the attached drawing Figures.

PREFERRED EMBODIMENT OF THE INVENTION

Figure 1:
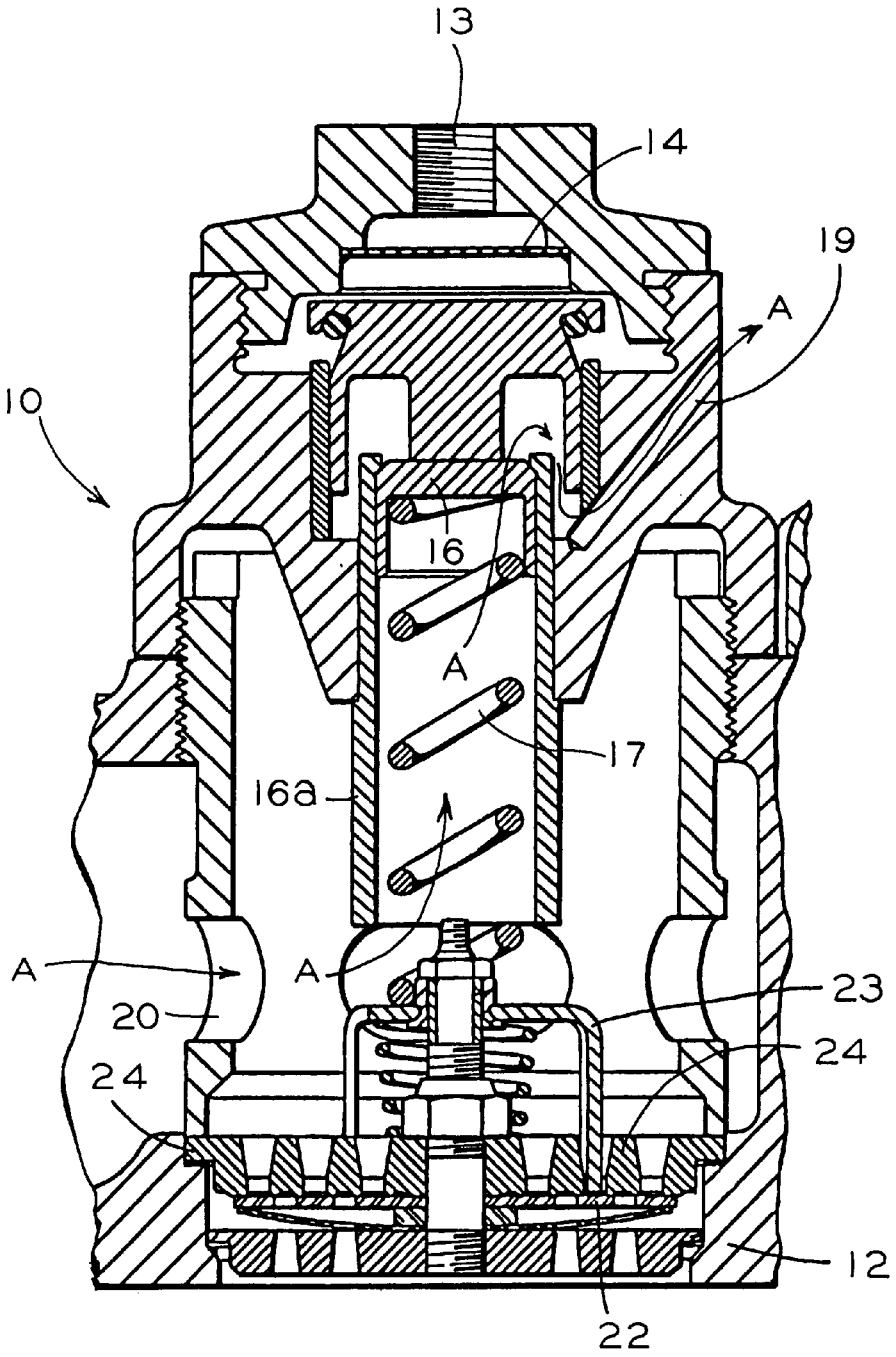
FIG. 1 PRIOR ART
FIG. 1 is a prior art unloader valve assembly for mounting in a head of a compressor for unloading the compressor, and through which intercooler pressure has heretofore been allowed to leak to atmosphere.

Prior to proceeding to the more detailed description of the present invention it should be noted that, for the sake of clarity and understanding of such invention, identical components which have identical functions have been identified with identical reference numerals throughout the drawing Figures.

Referring now, more particularly, to FIG. 1 of the drawings, an inlet unloader valve assembly, generally designated 10, is shown in section for unloading a cylinder and head 12 of a compressor 11 (FIG. 2), i.e., unloader valve assembly 10 exhausts compressed air in the head, cylinder and an intercooler 18 (FIG. 2) to atmosphere.

This occurs when an unload pneumatic pressure or pilot signal is communicated to and received by the unloader valve assembly 10 at a port 13 located immediately above a check valve 14 disposed within and closely adjacent the uppermost end of such unloader valve assembly 10. This is shown in FIG. 1 of the drawings. The pressure of the pilot signal moves the check valve 14 downwardly, which unseats an intercooler pressure seal valve 16, located in the upper end of a bushing 16*a* of the unloader assembly 10, against a spring 17 (located in bushing 16*a*) such that a path A is provided for the venting of air pressure present in an intercooler to atmosphere.

Intercooler output is connected to and enters into a port 20 of the unloader valve assembly 10. As shown in FIG. 1, venting path A includes port 20, unseated seal valve 16 and a relatively narrow passage 19 that vents to atmosphere. The size of such narrow passage 19 is on the order of one eighth (⅛) of an inch and path A includes an approximate 0.005 inch clearance between valve 16 and bushing 16*a* such that the flow rate therethrough and through passage 19 is extremely slow.

When the compressor governor reaches the cut-out pressure switch setting (140 psig), main reservoir pressure enters the unloader valves at upper port 13. Valve 14 in the unloader valve assembly 10 of FIG. 1 moves downwardly to open the intercooler pressure seal valve 16 as well as an inlet valve 22, via the unloader spring 17, which valve 22 includes an unloader cage 23. Cage 23 is an integral part of the inlet valve 22 and moves downwardly to unseat valve 22 from a fixed member 24. Pressurized air now enters unloader valve assembly 10 from cylinder head 12.

With the unloader valve assembly 10 actuated and the intercooler pressure seal valve 16 and inlet valve 22 held open, the compressor is unable to compress air. Therefore no load can be imposed upon the electric motor 26 (seen in FIG. 2) of the compressor.

When the main reservoir pressure decreases to the cut-in settings of the compressor governor switch, the unloader valve components move upwardly allowing the intercooler pressure seal valve 16 and inlet valve 22 to seat. The inlet valve is now closed for enabling the compression of air.

Intercooler(s) 18 contain a relatively low level of air pressure (e.g. on the order of forty-five psi) that is supplied by low pressure heads 12A and 12B (FIG. 2) of compressor 11 to intercooler 18. Such an intercooler cools the compressed air available from heads 12A and 12B before the air is sent on to high pressure head 12 for further compression. With the intercooler supplying air pressure to heads 12A and 12B, the heads 12A and 12B will remain pressurized even after being unloaded by the unloader valve assembly 10 until the intercoolers themselves are exhausted of air. Intercooler pressure takes about twenty-five seconds to approach within five psi of zero psi when intercooler pressure vents through passage 19 in valve assembly 10.

As explained earlier, today's modern compressors are driven by dual-speed electric motors 26 having dual different pole arrangements so that while a diesel engine of a locomotive is idling, the electric motor driving the compressor 11 can change to operate at a higher speed to provide the necessary supply of compressed air. When diesel engine speed increases, its alternator increases to an RPM appropriate for operating compressor motor 26 at an RPM suitable for the other pole arrangement of the motor 26. This other pole arrangement is energized and the idle pole arrangement deenergized when the diesel/alternator RPM increases to a predetermined throttle setting where the transition will take place.

The change between these two pole arrangements is rapid, on the order of two to three seconds, such that the relatively slow venting of the intercooler air to atmosphere (twenty five seconds) through the unloader valve assembly 10 permits residual air pressure to remain in the compressor heads 12A and 12B against which the compressor motor 26 must transition when it changes its pole configuration.

As was discussed earlier, the air pressure present in an air compressor will require a substantial work effort on the part of the electric motor 26 in starting against the load of compression in the air compressor. Because of such compression loads, the compressor motors overload and overheat to the point that the motors will fail (burn up) and have to be replaced by new or rebuilt motors.

Figure 2:
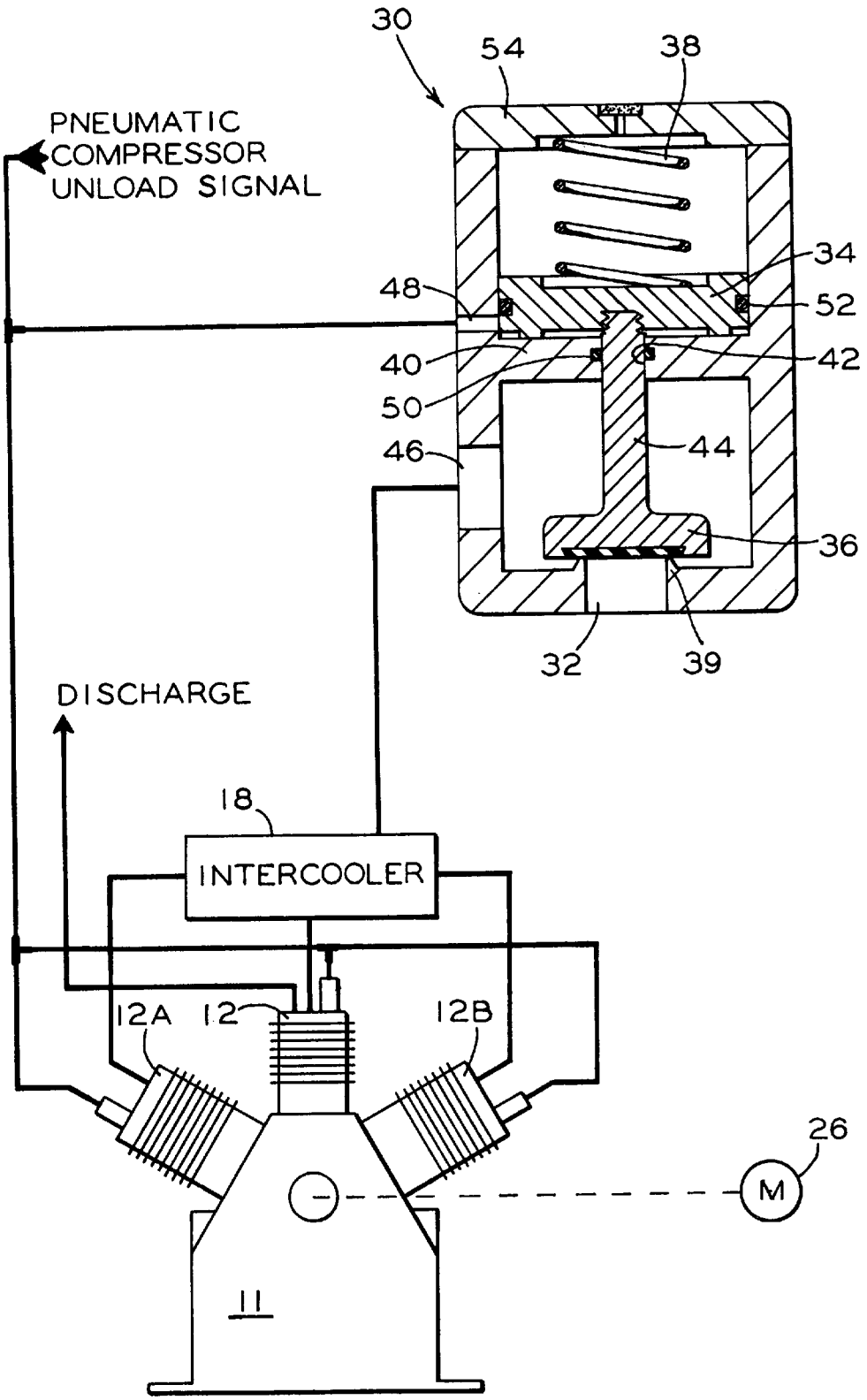
FIG. 2 is a schematic representation of a blowdown valve of the present invention connected in fluid communication with an intercooler and the high pressure head of an air compressor.

The present invention provides a poppet like blowdown valve, generally designated 30, as shown in FIG. 2. This poppet like blowdown valve 30 is connected in fluid communication with compressor cylinder heads 12A and 12B and intercooler 18. The valve 30 has a relatively large opening 32 to atmosphere that permits the rapid exhaustion of pressurized air in heads 12A and 12B and in the intercooler 18 when the above described unload pneumatic signal is received by blowdown valve 30.

More particularly, blowdown valve 30 has an upper piston 34 (in FIG. 2) connected to or formed as an integral part of a lower valve member 36. The upper piston 34 and valve member 36 are biased by an upper spring 38 to seat against a lower valve wall structure 39 located around large exhaust opening 32. Piston 34 is biased by spring 38 to seat on an inner transverse wall 40 of the valve 30. An opening 42 is provided in transverse wall 40 to receive an integral stem 44 of lower valve member 36. In FIG. 2, stem 44 is shown threaded into piston 34 so the piston 34 and lower valve member 36 move together to exhaust air pressure in heads 12A and 12B and intercooler 18.

Head and intercooler pressure is supplied to valve 30 via an inlet port 46. A second inlet port 48 is provided in the valve housing to receive the pneumatic unload signal and supply the same beneath the piston 34. The second inlet port 48 is located at the interface of piston 34 and transverse wall 40 so that the air pressure of the signal enters between the piston 34 and such transverse wall 40. The pressure of the signal is prevented from leaking past stem 44 by an O-ring sealing member 50 located in the transverse wall 40 about the opening 42. Similarly, an O-ring sealing member 52 is shown seated in the outer surface of piston 34 to prevent the signal pressure from leaking past the piston 34.

Bias spring 38 is provided with a spring constant that allows it to be compressed against an upper end wall 54 of the valve housing 30 when an unload signal is received at port 48. This permits such piston 34 to move in an upward direction (against the spring), and raises the lower valve member 36 from valve seat 39. When this occurs, the air pressure exhausts rapidly through the relatively large opening 32 in such valve housing 30. The exhaustion is rapid such that it occurs within the time frame of pole transition of the compressor motor 26. In this manner, the new pole configuration of motor 26 starts against an unloaded compressor, thereby saving the motor 26 from overload and eventual destruction.

While the presently preferred embodiment for carrying out the instant invention has been set forth in detail above, those persons skilled in the air compressor art to which this invention pertains will recognize various alternative ways of practicing the invention without departing from the spirit and scope of the claims appended hereto.

What is claimed is:

1. Apparatus for exhausting air pressure from an intercooler pneumatically connected to receive compressed air from an air compressor, said apparatus comprising:

(a) a blowdown valve pneumatically connected to receive air pressure contained in such intercooler, said blowdown valve having a large exhaust port;

(b) a valve member seatable against said exhaust port to open and close said exhaust port; and (c) means for conducting a compressor unload signal to said valve, said unload signal being effective to move said valve member away from said exhaust port to allow rapid exhaustion of intercooler air pressure to atmosphere through said exhaust port.

2. The apparatus, according to claim 1, wherein said apparatus further includes a biasing means located to bear against a piston connected to said valve member for biasing said valve member against said large exhaust port.

3. The apparatus, according to claim 2, wherein said biasing means is a spring.

4. The apparatus, according to claim 1, wherein said compressor is driven by an electric motor having a dual pole configuration that allows said electric motor to operate at least at two different speeds.

5. Apparatus for exhausting air pressure from an intercooler arrangement pneumatically connected to receive compressed air from a compressor driven by a dual speed electric motor, said apparatus comprising:

(a) a blowdown valve pneumatically connected to receive air pressure contained in such intercooler arrangement, said blowdown valve having a relatively large exhaust port with a valve member seatable against said exhaust port;

(b) a means for conducting a compressor pneumatic unload signal to said blowdown valve; and (c) a spring located in said blowdown valve for biasing said valve member against said large exhaust port in an absense of said unload signal to said blowdown valve;

said unload signal being effective to move said valve member away from said large exhaust port to exhaust intercooler air pressure to atmosphere through said exhaust port in a time required for such dual speed motor to change from a first speed to a second speed.

6. A method of rapidly venting intercooler pressure received from an air compressor to atmosphere, said method comprising the steps of:

(a) directing intercooler pressure and a pneumatic unload signal, respectively, to two ports provided in a housing of a blowdown valve;

(b) using said pneumatic signal to open a third, relatively large, exhaust port provided in said housing;

(c) rapidly exhausting said intercooler pressure to atmospheric through said large exhaust port; and (d) closing said exhaust port when said pneumatic signal is removed from a port receiving said pneumatic signal.

7. The method, according to claim 6, wherein said method includes using said pneumatic signal, in step (b), to move a piston and valve member in said blowdown valve in a manner that is effective in opening said large exhaust port in response to said piston receiving said pneumatic signal.

8. The method, according to claim 7, wherein said method includes using a spring in the blowdown valve to direct said valve member to said exhaust port when no pneumatic signal is received by the valve in step (d).

* * * * *